US007135969B2

(12) United States Patent
McLellan

(10) Patent No.: US 7,135,969 B2
(45) Date of Patent: Nov. 14, 2006

(54) THEFT DETERRENT FOR HOME APPLIANCES

(75) Inventor: Scott W. McLellan, Kempton, PA (US)

(73) Assignee: Agere Systems Inc, Allentown, PA (US)

( * ) Notice: Subject to any disclaimer, the term of this patent is extended or adjusted under 35 U.S.C. 154(b) by 355 days.

(21) Appl. No.: 10/773,622

(22) Filed: Feb. 6, 2004

(65) Prior Publication Data

US 2005/0174231 A1 Aug. 11, 2005

(51) Int. Cl.

| | |
|---|---|
| ***G08B 1/08*** | (2006.01) |
| ***G08B 13/00*** | (2006.01) |
| ***G08B 19/00*** | (2006.01) |
| ***G08B 21/00*** | (2006.01) |
| ***G08B 29/00*** | (2006.01) |

(52) U.S. Cl. ..... 340/540; 340/539.1; 340/539.14; 340/539.22; 340/539.27; 340/540; 340/506; 340/522; 340/686.1; 340/687

(58) Field of Classification Search ..... 340/540, 340/541, 539.1, 539.22, 825.72, 539.14, 340/539.27, 506, 522, 584, 686.1, 687; 714/14; 219/481, 497, 494

See application file for complete search history.

(56) References Cited

U.S. PATENT DOCUMENTS

| | | | | |
|---|---|---|---|---|
| 4,284,983 | A * | 8/1981 | Lent | 340/522 |
| 4,321,593 | A * | 3/1982 | Ho et al. | 340/541 |
| 4,494,114 | A * | 1/1985 | Kaish | 340/5.31 |
| 4,945,341 | A * | 7/1990 | Buttimer | 340/568.3 |
| 5,021,916 | A * | 6/1991 | Hubbard | 361/171 |
| 5,196,830 | A * | 3/1993 | Birging et al. | 340/584 |
| 5,592,032 | A * | 1/1997 | Keizer et al. | 307/116 |
| 5,625,345 | A * | 4/1997 | Stark et al. | 340/628 |
| 5,723,911 | A * | 3/1998 | Glehr | 340/10.5 |
| 5,734,206 | A * | 3/1998 | Keizer et al. | 307/116 |
| 5,797,358 | A * | 8/1998 | Brandt et al. | 122/448.1 |
| 6,046,441 | A * | 4/2000 | Daffron | 219/506 |
| 6,130,412 | A * | 10/2000 | Sizemore | 219/481 |
| 6,501,969 | B1 | 12/2002 | Cannon et al. | 455/574 |
| 2004/0145466 | A1 * | 7/2004 | Anthony et al. | 340/522 |
| 2005/0177769 | A1 * | 8/2005 | Stephen-Daly et al. | 714/14 |

* cited by examiner

*Primary Examiner*—Daniel Wu
*Assistant Examiner*—Lam Pham

(57) ABSTRACT

A security system for protecting home appliances includes an alarm system with a wireless link to the protected appliances. The appliances include circuitry that disables the appliance in response to a signal from the alarm system. The appliance or alarm system can also include circuitry that enables the appliance in response to a predetermined code applied to the appliance or in response to the alarm system.

17 Claims, 1 Drawing Sheet

THEFT DETERRENT FOR HOME APPLIANCES

FIELD OF THE INVENTION

The present invention relates generally to theft deterrent systems and, more particularly, to a theft deterrent system for home appliances.

BACKGROUND OF THE INVENTION

Theft deterrent systems for the home have become an increasingly important business. When armed, the systems produce a silent and/or audible alarm after intrusion is detected. Typical home alarm systems can also include various motion detectors throughout the home that can be armed when no one is at home.

While such systems are generally adequate, thieves could remove appliances before appropriate security personnel arrive in response to an alarm.

It is desirable, therefore, to provide an extra degree of theft deterrent for home appliances such as TVs, DVDs, and computer equipment.

In the automotive industry, automobile electronic equipment (e.g., car stereos) can include circuitry that disables the equipment when the equipment is disconnected from its power source, and then re-enables the equipment when an appropriate code is entered. Use of such a technique for home appliances would not be practical due to power grid electrical failures or merely the need to unplug the appliance for various reasons.

SUMMARY OF THE INVENTION

The present invention is directed to a security system that includes an alarm system and/or at least one appliance, both with circuitry providing wireless communication. The appliance or alarm system also includes circuitry that disables the appliance in response to a signal from the alarm system. The appliance or alarm system can also include circuitry that enables the appliance in response to a predetermined code applied to the appliance or in response to the alarm system.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following FIGURES:

The FIGURE is a block diagram of a system in accordance with an embodiment of the invention.

DETAILED DESCRIPTION OF THE INVENTION

Figure 1:
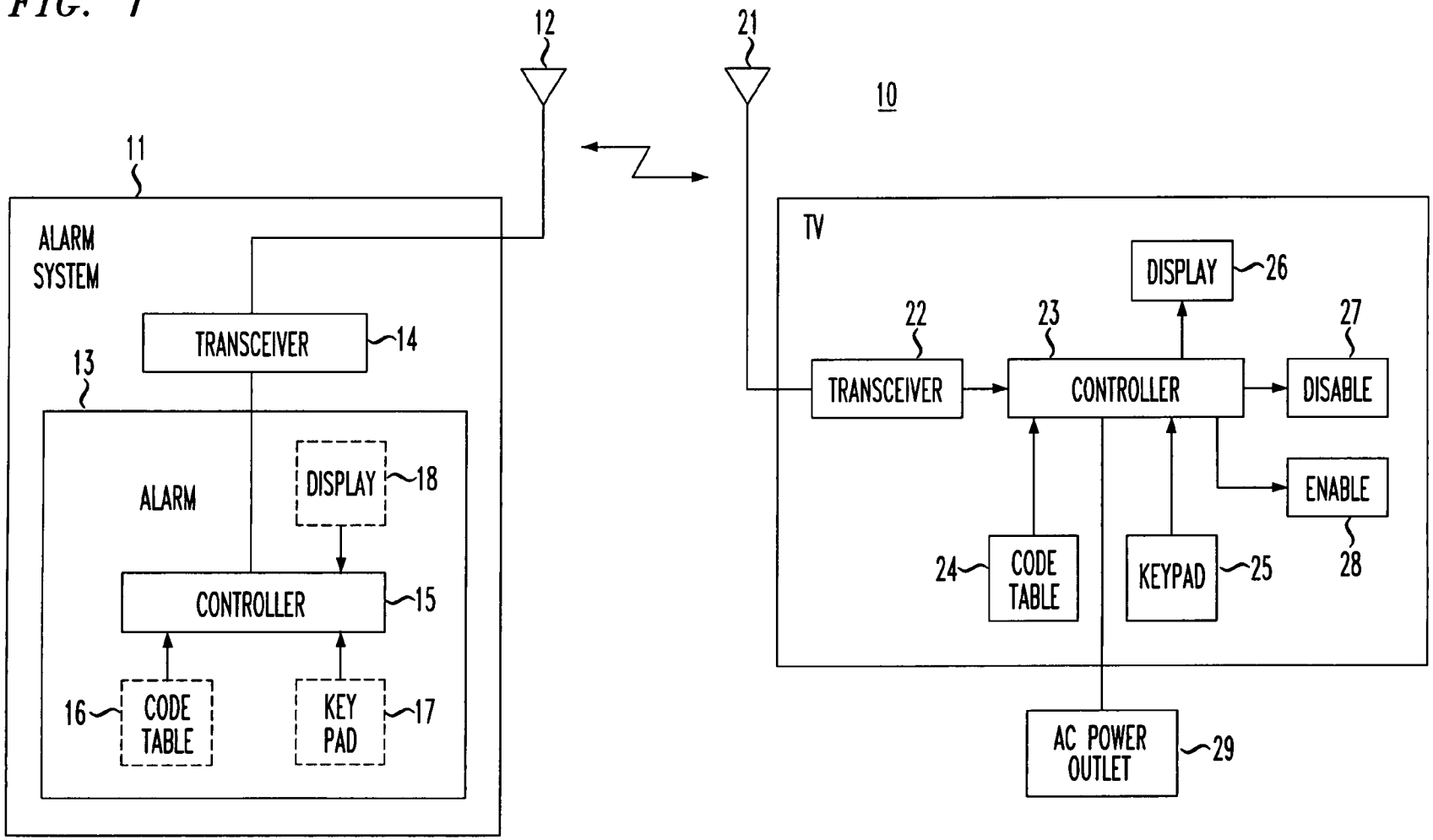

Referring now to the drawing, the FIGURE is a block diagram of a theft deterrent system, 10, in accordance with an embodiment of the invention.

The theft deterrent system includes an alarm system, 11, which detects intrusion into the home. The alarm system can be any of the standard types that are commercially available.

The circuitry, 13, which produces an alarm signal in response to an intrusion, includes a controller, 15, connected to a transceiver, 14, which is, in turn, connected to an antenna, 12. The controller, 15, can be the standard controller that controls overall functions of the alarm system, 11, and may be any suitable processor, e.g., a microprocessor, a digital signal processor (DSP) or a microcontroller. The transceiver and antenna provide wireless communication, in this case by radio frequency (RF), to any of the appliances which require additional protection. The transceiver and antenna can be the well-known types found, for example, in commercially available Bluetooth, IEEE standard 802.11 (Wi-Fi) or other communication systems. The use of a transceiver, 14, in this example provides two-way communication between the alarm system and appliances. If only one-way communication is desired, a transmitter can be employed in place of the transceiver.

One such appliance to be protected is a TV illustrated by block 20. The appliance also includes an antenna, 21, connected to a transceiver, 22, for receiving communication from the alarm system, 11. If only one-way communication from the alarm system is desired, a receiver can replace the transceiver. The transceiver, 22, is connected to a standard controller, 23, which controls overall functions of the appliance. The controller may be any suitable processor, e.g., a microprocessor, a digital signal processor (DSP) or a microcontroller, and is typically part of or embedded in the appliance control circuitry. A table including a designated code is stored in memory, 24, which is accessible by the controller, 23. The code can be entered by an authorized person using a keypad, 25, and viewed on a display, 26.

At least one output of the controller, 23, is coupled to circuitry for disabling and enabling the appliance, illustrated as blocks 27 and 28. While shown as two blocks, the circuitry would normally be one circuit that disables the appliance according to one signal from the controller (e.g., a "1") and enables the appliance according to a different signal from the controller (e.g., a "0"). This circuitry can be similar to those found in car radios and the like for disabling the equipment when an attempt is made to remove the equipment. The controller, as well as the rest of the appliance, is powered by a standard AC power source, 29.

In operation, the alarm system, 11, would be armed in the usual manner to detect intruders. If intrusion is detected, the alarm system would send an RF signal from the transceiver, 14, of the alarm to the transceivers, e.g., 22, of all the protected appliances, e.g., 20. The controller, 23, receives the signal from the alarm system, 11, and in response thereto, transmits a signal to the disable circuit, 27, to shut down the appliance. More conveniently, the controller could be programmed to disable the appliance only when it receives the signal from the alarm and the appliance is disconnected from the power source, 29. This would prevent shutting down of the appliances when a false alarm is generated by the alarm system, 11. In any event, the appliance would remain disabled until someone enters the designated code stored in memory, 24, by means of the keypad, 25, so that an appropriate signal is sent from the controller to the enable circuit 28. Alternatively, the alarm system, 11, could transmit an enable signal that would re-enable the appliance, 20, after the alarm system, 11, has been reset. The display, 26, or other sign could be used to notify a would-be thief that the appliance would be useless if taken from the premises.

While the embodiment shows the code table, 24, keypad, 25, and display, 26, located in the appliance, 20, these elements could also be included in the alarm system, 11, as shown by the phantom elements, 16, 17, and 18, respectively. In that case, the appropriate code for enabling the appliances could be entered by a user to the alarm system, 11, and the appropriate enable signal sent over the wireless link between the alarm system and the appliances.

In this example, since the alarm system, 11, and appliances, 20, have two way communication between them, suitable commercially available encryption technology can be employed to protect the link from "spoofing", which would otherwise allow the appliances, 20, to respond to a false enable or disable signal transmitted by a malicious outsider or thief.

Although the invention has been described with reference to exemplary embodiments, it is not limited to those embodiments. Rather, the appended claims should be construed to include other variants and embodiments of the invention that may be made by those skilled in the art without departing from the true spirit and scope of the present invention.

What is claimed:

1. A security system comprising:

an alarm system including circuitry providing wireless communication;

at least one appliance including circuitry providing wireless communication, and circuitry which disables the appliance in response to a signal from the alarm system, wherein the disabling circuitry disables the appliance only when there is both a signal from the alarm system and a disconnection of the appliance from a power supply.

2. The security system according to claim 1 further comprising circuitry that enables the appliance when a predesignated code is applied to the circuit.

3. The security system according to claim 2 wherein the enabling circuitry is located in the appliance.

4. The security system according to claim 2 wherein the enabling circuitry is located in the alarm system.

5. The security system according to claim 1 wherein the circuitry providing wireless communication in the appliance and alarm system includes a transceiver.

6. A security system comprising an alarm system including circuitry providing wireless communication and adapted to provide a wireless signal to an appliance including circuitry which disables the appliance, wherein the disabling circuitry disables the appliance only when there is both a signal from the alarm system and a disconnection of the appliance from a power supply.

7. The security system according to claim 6 further comprising circuitry that enables the appliance when a predesignated code is applied to the circuit.

8. The security system according to claim 6 wherein the circuitry in the alarm system comprises a controller.

9. The security system according to claim 8 wherein the controller is selected from a microprocessor, a digital signal processor, and a microcontroller.

10. The security system according to claim 6 wherein the circuitry further comprises memory for including a code, a keypad for entering the code, and a display.

11. The security system according to claim 6 wherein the circuitry providing wireless communication includes a transceiver in the alarm system.

12. An appliance comprising circuitry providing wireless communication with an alarm system, and circuitry which disables the appliance in response to a signal from the alarm system, wherein the circuitry disables the appliance only when there is both a signal from the alarm system and a disconnection of the appliance from a power supply.

13. The appliance according to claim 12 further comprising circuitry which enables the appliance when a predesignated code is applied to the circuit.

14. The appliance according to claim 12 wherein the circuitry in the appliance comprises a controller.

15. The appliance according to claim 14 wherein the controller is selected from a microprocessor, a digital signal processor, and a microcontroller.

16. The appliance according to claim 12 wherein the appliance further comprises memory for including a code, a keypad for entering the code, and a display.

17. The appliance according to claim 12 wherein the circuitry providing wireless communication includes a transceiver in the appliance.

* * * * *